US009818290B2

(12) United States Patent
Lewandowski

(10) Patent No.: US 9,818,290 B2
(45) Date of Patent: Nov. 14, 2017

(54) SECURITY SYSTEM AND METHOD FOR VERIFYING THE MERITS OF AN ALERT SIGNAL

(71) Applicant: Donald Lewandowski, Ft. Lauderdale, FL (US)

(72) Inventor: Donald Lewandowski, Ft. Lauderdale, FL (US)

( * ) Notice: Subject to any disclaimer, the term of this patent is extended or adjusted under 35 U.S.C. 154(b) by 0 days.

(21) Appl. No.: 15/058,644

(22) Filed: Mar. 2, 2016

(65) Prior Publication Data

US 2017/0076582 A1 Mar. 16, 2017

Related U.S. Application Data

(60) Provisional application No. 62/216,473, filed on Sep. 10, 2015.

(51) Int. Cl.

| | |
|---|---|
| ***G08B 25/00*** | (2006.01) |
| ***G08B 21/00*** | (2006.01) |
| ***G08B 23/00*** | (2006.01) |
| *G08B 29/16* | (2006.01) |

(52) U.S. Cl.

CPC ..... *G08B 25/001* (2013.01); *G08B 21/00* (2013.01); *G08B 23/00* (2013.01); *G08B 29/16* (2013.01)

(58) Field of Classification Search

CPC .... H04M 11/04; H04M 1/72536; H04W 4/22; G08B 27/00; G08B 25/006; G08B 15/001; G08B 25/14; H04L 63/083

See application file for complete search history.

(56) References Cited

U.S. PATENT DOCUMENTS

| | | | | |
|---|---|---|---|---|
| 4,918,717 | A | 4/1990 | Bissonnette | |
| 5,511,109 | A | 4/1996 | Hartley | |
| 2003/0061621 | A1* | 3/2003 | Petty | G08B 13/19656 725/105 |
| 2008/0111676 | A1* | 5/2008 | Dobbs | G08B 25/14 340/506 |
| 2008/0311879 | A1* | 12/2008 | Martin | G08B 25/08 455/404.1 |
| 2011/0133909 | A1 | 6/2011 | Beach | |
| 2012/0250833 | A1* | 10/2012 | Smith | H04M 11/04 379/45 |

(Continued)

*Primary Examiner* — Mirza Alam

(74) *Attorney, Agent, or Firm* — Vincent G. Lotempio; Kloss, Stenger & Lotempio; David T. Stephenson

(57) ABSTRACT

A security system and method verifies the merits of an alert signal generated by an alarm device. The alarm device is integrated into a premise of a user, and emits an alert signal when an irregular event occurs. The security system and method verifies the merit of the alert signal, so as to differentiate between a false alarm and a true alarm. To achieve the verification, upon detecting and recognizing an alert signal, a remote alarm center attempts to communicate with the end-user through simultaneous channels of communication. The simultaneous use of a plurality of channels of communication enables the remote alarm center to expedite communications with the end-user regarding the triggered alert signal. Upon receiving communication about the triggered alert signal, the end-user may indicate to the remote alarm center, through transmission of a code and within a predetermined duration, the merits of the triggered alert signal.

20 Claims, 3 Drawing Sheets

(56) References Cited

U.S. PATENT DOCUMENTS

| | | | | |
|---|---|---|---|---|
| 2012/0275588 | A1* | 11/2012 | Gregory | H04M 3/38<br>379/102.02 |
| 2014/0038544 | A1* | 2/2014 | Jones | G08B 13/196<br>455/404.2 |

* cited by examiner

SECURITY SYSTEM AND METHOD FOR VERIFYING THE MERITS OF AN ALERT SIGNAL

This application claims the benefit of U.S. Provisional Application No. 62/216,473, filed on Sep. 10, 2015.

FIELD OF THE INVENTION

The present invention relates generally to a security system and method for verifying the merits of an alert signal. More so, the security system and method is configured to verify the merits of an alert signal generated by an alarm device at a premises of a user by: providing an alarm device at a premises; operatively connecting the alarm device with a remote alarm center that receives a triggered alert signal; recognizing identifying information from the alert signal; simultaneously opening a plurality of communication channels with the end-user regarding the alert signal; and then depending on the user's response before or after a predetermined duration, deactivating the alarm device or reporting the alert signal to an alert response organization.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

In most instances, conventional security alarm systems utilize multiple event sensors for detecting events such as emergencies or unauthorized entries in a predetermined guard area, a means for converting the emergency data of the sensors into electric signals, and a security controller for transmitting the electric signals to a central station through cable or by radio.

Typically, the event sensors which are positioned throughout a structure, such as a home or warehouse. The event sensors include motion detectors, vibration detectors, and heat sensors. Furthermore, the home or warehouse is typically divided into two or more security zones, such as the garage, the basement, a main living quarters, and an office area.

Often, the security systems include a main control unit which constantly monitors all of the intruder sensors in the system. Upon the receipt of a signal from one of the intruder sensors, the main control unit sounds sirens, lights, sends signal to a remote location, and the like in an attempt to alert police or to alert the neighbors to call the police or otherwise apprehend the intruder. Typically, the alarm is activated for a preset period of time, such as ten minutes, after which the system resets.

It is known that some disadvantages of these previously known home security systems is that no warning is given to the owner of a possible intruder presence just before entering the house. Also, these systems are prone to false alarms. Consequently, after a few false alarms, neighbors tend to ignore subsequent alarms even though such alarms are not false alarms.

Thus, in many instances, with these previously known systems the possibility arises that the intruder can enter the home and deactivate the alarm sirens and lights while the neighbors treat the initial activation of the alarms as a false alarm. This is particularly dangerous for the homeowner when he or she returns to the home since the intruder may still be present within the home.

Other proposals have involved remote security systems. The problem with these security systems is that they do not enable a homeowner to disable the alarm with a code, or allow an alert response organization to identify which homeowner is disabling the alarm. Even though the above cited security systems meets some of the needs of the market, a security system and method that verifies the merits of an alert signal generated by an alarm device at a premises of a user is still desired.

SUMMARY OF THE INVENTION

The present invention is directed to a security system and method that verifies the merits of an alert signal generated by an alarm device. The system and method enables a user to deactivate a falsely triggered alarm, and also allows an alert response organization to identify the user and the corresponding premises to better recognize the validity of the alert signal.

In some embodiments, the alarm device is integrated into a premises of a user, and emits an alert signal when an irregular event occurs. The security system and method verifies the merit of the alert signal, so as to differentiate between a false alarm and a true alarm. To achieve the verification, upon detecting and recognizing an alert signal, a remote alarm center attempts to communicate with the end-user through simultaneous channels of communication.

The simultaneous use of a plurality of channels of communication enable the remote alarm center to expedite communications with the end-user regarding the triggered alert signal. Upon receiving communication about the triggered alert signal, the end-user may indicate to the remote alarm center, through transmission of a code and within a predetermined duration, the merits of the triggered alert signal.

In one aspect of the present invention, a security method for verifying the merit of a detected alert signal, comprises:

- integrating an alarm device at a premises of an end-user;
- operatively connecting at least one identifying information of the end-user and the premises to a remote alarm center, the remote alarm center having a data storage portion for storing the identifying information;
- triggering an alert signal, by the alarm device, the alert signal configured to indicate an irregular event, the alert signal comprising the at least one identifying information of the end-user and the premises;
- detecting the alert signal, by the remote alarm center;
- recognizing the at least one identifying information from the alert signal;
- simultaneously opening a plurality of communication channels with the end-user regarding the alert signal; and
- waiting a predetermined duration after opening the plurality of communication channels for receipt of a code from the end-user, the code configured to cancel the need to contact the response organization.

In a second aspect, the alarm device includes at least one of the following: window detectors, door detectors, motion sensors, smoke sensors, fire sensors, and medical button both digital and analog (CCTV) image or acquisition devices, and cameras.

In another aspect, the premises is an entry or exit point within a perimeter, a border, and a building.

In another aspect, the end-user purchases a subscription with the remote alarm center 104 to receive a security service.

In another aspect, the step of detecting the alert signal, by the remote alarm center 104, further includes wirelessly, landline, or I.P. dialer detecting the alert signal.

In another aspect, the step of detecting the alert signal, by the remote alarm center 104 further comprises recognizing the caller ID of the end-user.

In another aspect, the predetermined duration is about one to five minutes.

In another aspect, the plurality of communication channels comprises at least three land lines and/or three cellular phone calls.

In another aspect, the plurality of communication channels comprises a computer generated voice or text.

In another aspect, the step of deactivating the alarm device, by the remote alarm center, upon receipt of the code before expiration of the predetermined duration, further includes the end-user transmitting the code through a keypad of a cellular phone, landline phone or via text.

One objective of the present invention is to provide a security system that verifies between a false alarm and a true alarm.

Another objective is to reduce costs in monitoring alarms by reducing the time to detect and recognize the alert signal generated by the alarm device.

Another objective is to provide a security system and method that is adaptable to operate with a variety of security hardware and software.

Another objective is to generate revenue by selling subscriptions to the security system to end-users.

Another objective is to provide faster response times and lower costs for the security system.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
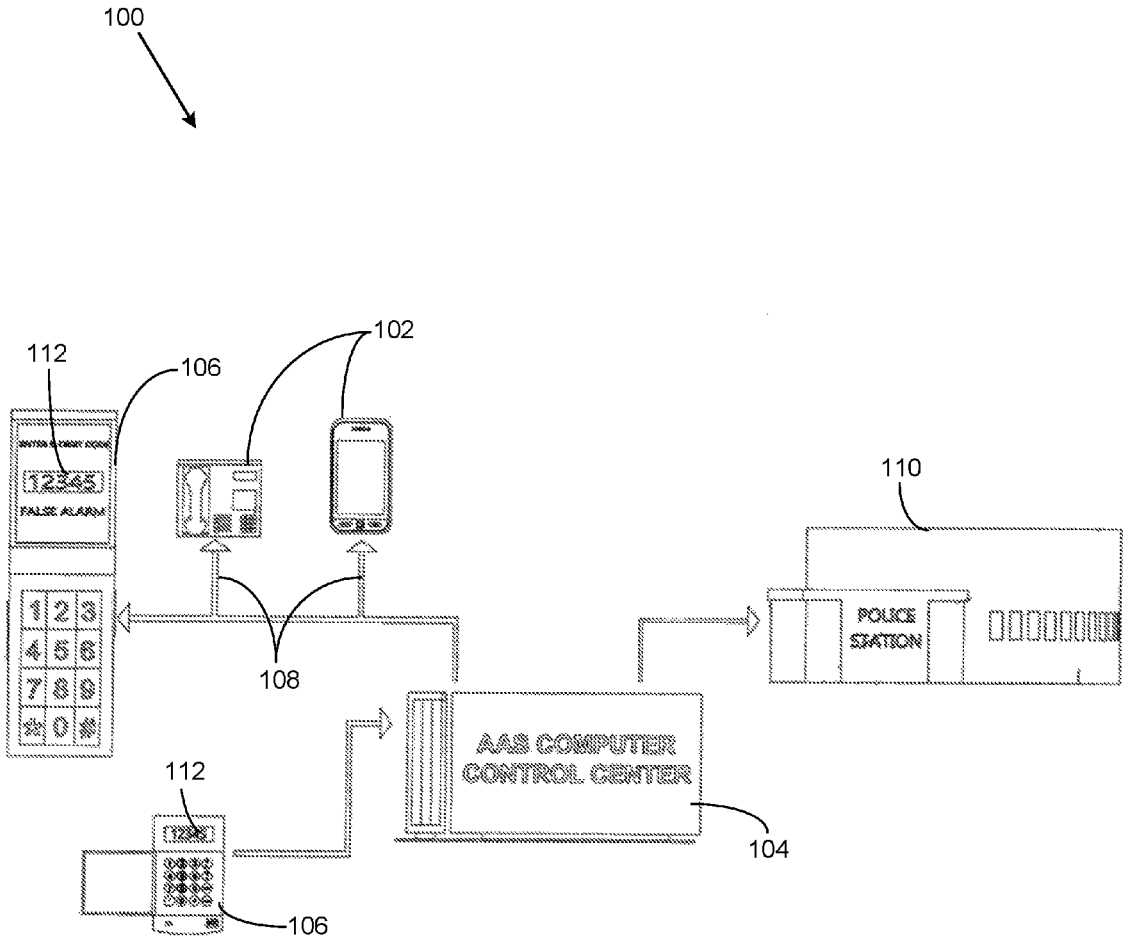
FIG. 1 illustrates a block diagram of an exemplary system for verifying the merits of an alert signal, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. §112.

Figure 2A:
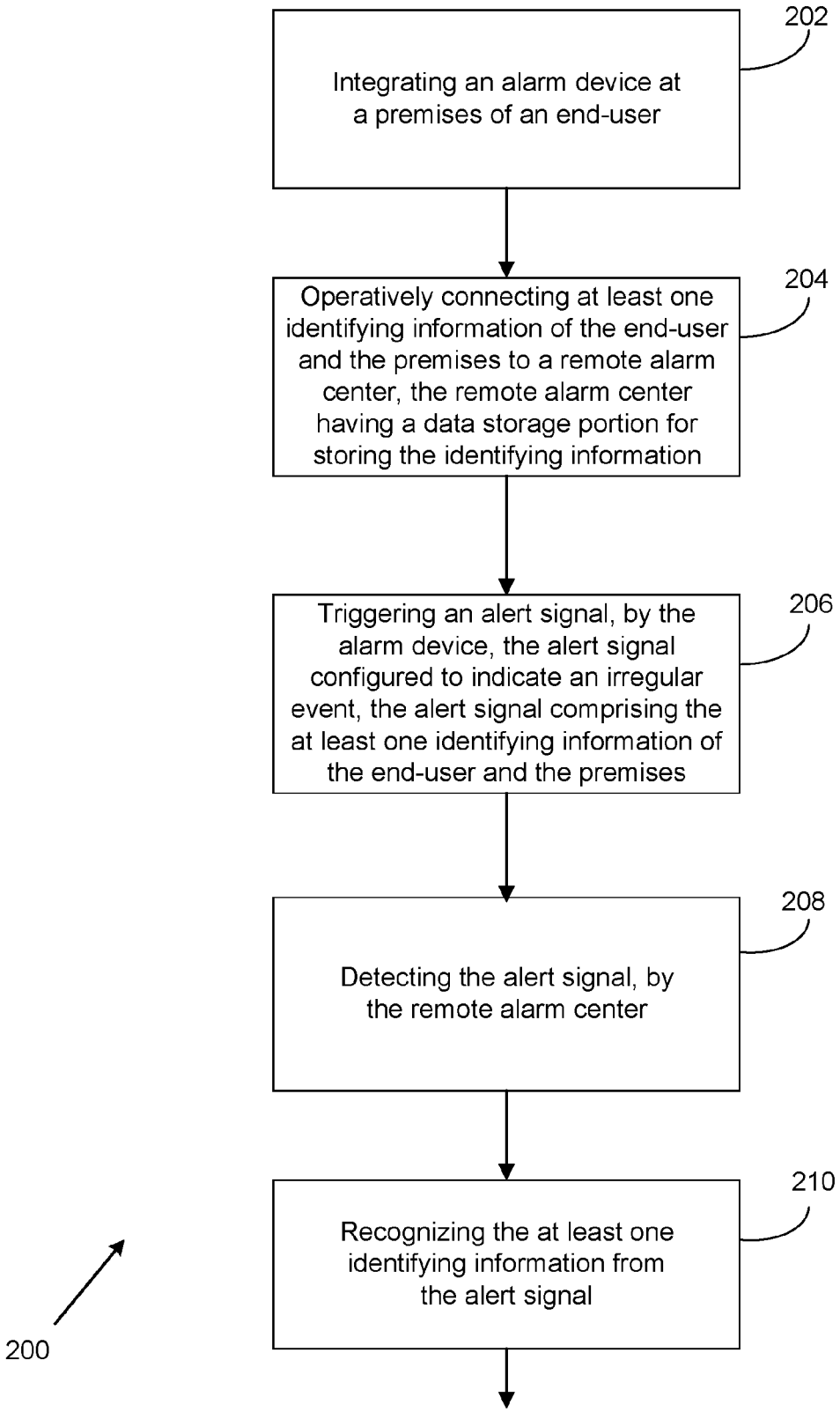
FIGS. 2A and 2B illustrate a flowchart diagram of an exemplary method for verifying the merits of an alert signal, in accordance with an embodiment of the present invention.
Figure 2B:
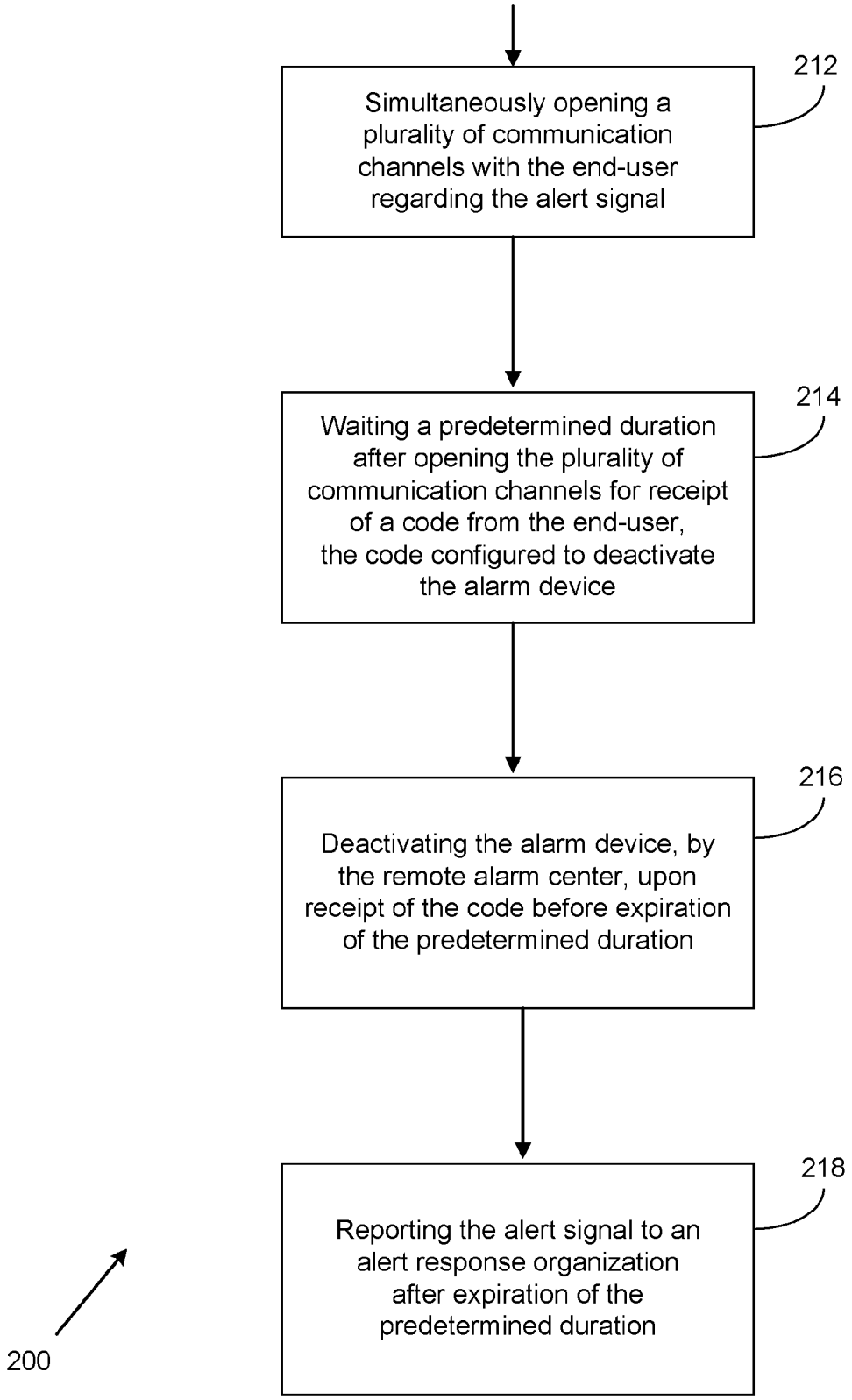

In one embodiment of the present invention presented in FIGS. 1-2B, a security system 100 and method 200 is configured to verify the merits of a detected alert signal that is generated by an alarm device 106. Alarm device 106 is integrated into a premises of a user, and emits an alert signal when an irregular event occurs at or near the secured premises. Security system 100 and method 200 work to verify the merits of the generated alert signal, so as to differentiate whether the alert signal is a false alarm or a true alarm.

To achieve the verification, upon detecting and recognizing an alert signal, a remote alarm center 104 attempts to simultaneously communicate with the end-user 102 through a plurality of communication channels 108. The simultaneous use of communication channels 108 enables remote alarm center 104 to expedite communications with end-user 102 regarding the triggered alert signal. This reduces response time and costs associated with responding to the alert signal.

Upon receiving notice of the triggered alert signal from remote alarm center 104, the end-user 102 may indicate to remote alarm center 104, through transmission of a code 112 that the alarm is false and within a predetermined duration. It is significant to note that each communication channel 108 can have a different code 112 that can be changed by the end-user 102. For example, if code 112 is received within the predetermined duration, the alert signal is unsubstantiated. However, if code 112 is not received by remote alarm center 104, the alert signal is a true alarm and alert response organization 110 will be contacted.

Based on reception of code 112, the remote alarm center 104 will not contact alert response organization 110. If remote alarm center 104 receives a verified alarm response from the end-user 102 and type of alarm via a code 112, i.e., 911 for police, 211 for ambulance, 311 for fire, without waiting a predetermined duration, then the remote alarm center 104 will contact alert response organization 110 and alert response organization 110 will respond appropriately on a priority level.

The above system 100 and method 200 is not only effective for verifying the merit of the generated alert signal, but also allows for a generally more efficient security on the premises of the end-user. It is known that security and personal safety are major concerns for end-users, and their loved ones. For example, homeowners wish to protect their valuables and maintain safe havens for themselves and their family members. Similarly, business owners also wish to protect inventory, often found in warehouses, offices, and vaults. Additionally, cybersecurity requires security for servers, computers, and networks.

Thus, to generate an appropriate alert signal, an alarm device 106 is integrated into the premises and the alert signal is generated when an irregular event is detected at the premises, and especially at the region or item to be protected. The security system 100 and method 200 verifies the merit of the alert signal in a timely and efficient manner.

Those skilled in the art will recognize that alarm devices frequently interpret triggered alert signals that are false alarms as true alarms. This scenario may occur where the alarm device 106 detects an irregular event, such as an intrusion, at a protected premises where the irregular event was merely a family member that inadvertently triggered the alert signal, and the alarm device 106 triggered a false alarm. Other false alarm triggering irregular events may include, without limitation, an unauthorized entry; excessive movement; incorrect entry procedures, such as inputting an incorrect password or key; and animals or unexpected visitors breaching a protected entry or exit zone, falling branches detected as intrusions, loud noises generated by car crashes, windows breaking, and any other innocent and inadvertent occurrences.

Consequentially, these false alarms pose a serious problem in communities where homes and business are protected with such conventional alarm devices. False alarms reported from conventionally protected homes and businesses deplete police resources and undermine the credibility of the security and alarm devices that appear to repeatedly malfunction.

As shown in FIG. 1, security system 100 requires integrating alarm device 106 into the premises of the end-user 102. Alarm device 106 may be tied into components of the premises that are generally known to require security, such as windows, doors, roofs, and general perimeters of building and tracts of land. In one alternative embodiment, security system 100 is configured to provide and verify the merits for cybersecurity. This embodiment may require alarm device 106 to be operable to generate an alert signal when an irregular event occurs with hardware, software, and networks on the premises.

Alarm device 106 may include, without limitation, window detectors, door detectors, motion sensors, both digital and analog (CCTV) image or acquisition devices, and cameras, e.g., network cameras for surveillance or monitoring alarm zones that are particularly susceptible to breach. The premises in which alarm device 106 is integrated may include, without limitation, a residential home, a warehouse, a ranch, a barn, a vault, and a secure area.

Alarm device 106 is configured to trigger an alert signal, which is then transmitted to the remote alarm center 104 for additional verification steps. The alert signal may include an audible sound, illumination, and wireless data. The alert signal also includes at least one identifying data. The identifying data includes the location of the alarm device 106, the personal information of end-user 102, and technical information about alarm device 106. In some embodiments, the identifying data may also include, without limitation, a name, a phone number, an address, a coordinate, and an image of the premise.

Looking again at FIG. 1, alarm system 100 is operatively connected to a remote alarm center 104. Remote alarm center 104 serves, essentially, as a central data storage and communication base that serves, chiefly to maintain, monitor, and communicate with alarm device 106, end-user 102, and alert response organization 110. In one possible embodiment, remote alarm center 104 comprises a data storage portion, which may include, without limitation, a server, a database, an alarm device 106, an end-user 102, a code 112, an alert response organization 110, a processor, a network, the Internet, landlines, and a cloud.

The data storage portion of the remote alarm center 104 is operable to store the identifying information of the end-user 102, the alarm device 106, the premises, and the alert response organization 110. The data storage portion, in essence, stores the registered end-users. This stored identity information may also be used for billing end-user 102, or other ancillary purposes. One exemplary remote alarm center 104 comprises a computer with access to multiple phone lines, based on registered end-users, with battery, generator back up, and a mirrored unit for complete redundancy for a fail safe operation.

Those skilled in the art will recognize that the stored identifying information may be useful when monitoring and communicating with a plurality of alarm devices, end-users, and alert response organization. Thus, remote alarm center 104 not only detects the transmitted alert signal, but also recognizes the identifying information contained in the alert signal. This capacity to match identifying data in the remote data storage portion and the alert signal enables remote alarm center 104 to contact the appropriate end-user and alert response organization for communicating the alert signal.

Upon receiving the alert signal, the remote alarm center 104 simultaneously opens a plurality of communication channels 108 with end-user 102, regarding the alert signal. It is significant to note that the capacity of the remote alarm center 104 to utilize different types of communication channels 108 simultaneously provides novelty to security system 100. This is because response time is reduced by not having to initiate individual and different means of communication with the end-user 102. Those skilled in the art will recognize that in a security breach, time is of the essence, and using the correct communication channel is effective in expediting the process of contacting end-user to verify the merits of the alert signal.

In one possible embodiment, communication channels 108 include at least three land lines and/or three cellular phone calls. Though in other embodiments, emails, texts, and light signals may be used as communication channels between remote alarm center 104 and end-user 102. In one embodiment, end-user 102 has the option to change communication channels 108 and codes 112 through a personal secure web login page or an app.

Those skilled in the art, in light of the present teachings, will recognize that an end-user of an alarm device can often own a cellular phone, and have knowledge of the occupants of and visitors to a protected home or premises. The present invention utilizes the accessibility provided by cell phone communicating and cell phone end-user knowledge of the premises by automatically contacting end-user 102 when a triggered alert signal is detected. End-user 102 may then easily and quickly verify with the cell phone whether the triggered alert is a true or false alarm.

Upon achieving communication with end-user 102, the remote alarm center 104 waits for a predetermined duration before performing additional activity. The predetermined duration provides the time limitation at which remote alarm center 104 either will cancel the alarm, or report the alert signal to the alert response organization 110. In one embodiment, the predetermined duration is about 1 to 5 minutes.

In some embodiments, end-user 102 must provide a code 112 to remote alarm center 104 before the predetermined duration expires to indicate that the triggered alert signal is a false alarm, as described above. End-user 102 may transmit code 112 through any means of rapid communication. In one embodiment, code 112 may include a password or a PIN. Upon receiving code 112, the remote alarm center 104 may reinitiate alarm system 100 to trigger a future alert signal for the next irregular event.

Conversely, if end-user 102 does not provide a code 112, or if end-user 102 communicates that the alert signal is a true alarm, then remote alarm center 104 contacts the alert response organization 110 for appropriate response to the alert signal. The identifying information contained in the alert signal may also be communicated to the alert response organization 110 to help in expediting the response. Alert response organization 110 may include, without limitation, police, firemen, emergency medical personnel, and military personnel.

In one exemplary use of the security system 100, when alarm device 106 is activated, a notification is sent to an operator at remote alarm center 104 via a wireless, I.P. dialer or a dial-up connection. Typically, an operator at the central station calls back the end-user 102 and attempts to validate the alert signal, through verbal exchange of code 112 or password. Failure to validate the alarm with the code 112 results in a call being placed to the alert response organization 110. It is significant to note that if a local policing agency does not accept data or a recording of the address from the remote alarm center 104, the alerting of the police agency may have to be done directly over the telephone or in person by an agent of the remote alarm center 104.

FIGS. 2A and 2B illustrate a flowchart diagram of an exemplary method 200 for verifying the merit of an alert signal. The method 200 is configured to verify the merit of the alert signal, so as to differentiate between a false alarm and a true alarm. To achieve the verification, upon detecting and recognizing an alert signal, a remote alarm center 104 attempts to contact end-user 102 with simultaneous channels of communication.

In some embodiments, the simultaneous channels 108 of communication enable remote alarm center 104 to initiate simultaneous communication with end-user 102 regarding the triggered alert signal. Upon receiving communication about the triggered alert signal, the end-user 102 indicates to the remote alarm center 104, through transmission of code 112 and within a predetermined duration, the merits of the triggered alert signal. Remote alarm center 104 may then make the appropriate decision of either deactivating alarm device 106, or reporting the alert signal to the alert response organization 110.

Method 200 comprises an initial Step 202 of integrating an alarm device 106 at a premises of an end-user 102. Alarm system 100 is set up to initiate an alert signal when an irregular event occurs. Method 200 may further comprise a Step 204 of operatively connecting at least one identifying information of the end-user 102 and the premises to a remote alarm center 104, the remote alarm center 104 having a data storage portion for storing the identifying information. Remote alarm center 104 stores the identifying data for a plurality of alarm devices and end-users. In this manner, the appropriate end-user 102 may be contacted upon detecting an alert signal, and the alert response organization 110 can be sent to the appropriate premises to respond to the alert signal.

A Step 206 includes triggering an alert signal, by the alarm device 106, the alert signal configured to indicate an irregular event, the alert signal comprising the at least one identifying information of the end-user 102 and the premises. The alert signal may include an audible sound, illumination, and wireless data. The alert signal also includes identifying data to help discern the location and identity of end-user 102 and alarm device 106.

In some embodiments, a Step 208 comprises detecting the alert signal, by the remote alarm center 104. Remote alarm center 104 may wirelessly receive and detect the alert signal instantaneously. A Step 210 includes recognizing the at least one identifying information from the alert signal. The data storage portion of remote alarm center 104 includes the identity of the end-users and the locations of the alarm devices. Thus, the received alert signal containing the identifying information can be matched accordingly to recognize the appropriate alarm device 106. In this manner, alert response organization 110 can respond more accurately to the appropriate premises and end-user. Alert response organization 110 can also know when to respond or disregard the alert signal.

In some embodiments, a Step 212 may include simultaneously opening a plurality of communication channels 108 with end-user 102 regarding the alert signal. The capacity of remote alarm center 104 to utilize communication channels 108 simultaneously provides novelty to security system 100. This is because precious time is saved by not having to initiate separate channels of communication with the end-user 102. A Step 214 comprises waiting a predetermined duration after opening the plurality of communication channels 108 for receipt of a code 112 from the end-user 102, the code 112 configured to cancel the need to contact the alert response organization 110. The predetermined duration provides time for end-user 102 to indicate, through code 112, that the alert signal is a false alarm.

The method 200 may further include deactivating the alarm device 106, by the remote alarm center 104, upon receipt of the code 112 before expiration of the predetermined duration. End-user 102 must provide code 112 to the remote alarm center 104 before the predetermined duration expires to indicate that the triggered alert signal is a false alarm, as described above.

The method 200 may further include reporting the alert signal to an alert response organization 110 after expiration of the predetermined duration. Thus, if end-user 102 does not provide code 112, or if end-user 102 communicates that the alert signal is a true alarm, then remote alarm center 104 contacts the alert response organization 110. The identifying information contained in the alert signal may also be communicated to the alert response organization 110 to help in expediting the response.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

These and other advantages of the invention will be further understood and appreciated by those skilled in the art by reference to the following written specification, claims and appended drawings.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. A security method for verifying a merit of a detected alert signal, comprises:

integrating an alarm device at a premises of an end-user, wherein the end-user is at least one of a person who ultimately uses the security method and a person who is intended to ultimately use the security method;

operatively connecting at least one identifying information of the end-user and the premises to a remote alarm center, the remote alarm center having a data storage portion for storing the at least one identifying information;

triggering an alert signal, by the alarm device, the alert signal configured to indicate an irregular event, the alert signal comprising the at least one identifying information of the end-user and the premises;

detecting the alert signal, by the remote alarm center;

recognizing the at least one identifying information from the alert signal;

simultaneously opening a plurality of communication channels between the remote alarm center and the end-user, wherein the communication channels are of at least a first medium and a second medium, with the end-user regarding the alert signal; and waiting a predetermined duration after opening the plurality of communication channels for receipt of a code from the end-user, the code configured to cancel a need to contact a response organization.

2. The method of claim 1, further including a step of reporting the alert signal to an alert response organization after expiration of the predetermined duration.

3. The method of claim 1, further including a step of deactivating the alarm device, by the remote alarm center, upon receipt of the code before expiration of the predetermined duration.

4. The method of claim 1, wherein the alarm device includes at least one of the following: window detectors, door detectors, motion sensors, smoke sensors, fire sensors, and medical button both digital and analog closed caption television images or acquisition devices, and cameras.

5. The method of claim 1, wherein the premises is an entry point or an exit point within a perimeter, a border, and a building.

6. The method of claim 1, further including a step of purchasing, by the end-user, a subscription with the remote alarm center to receive a security service.

7. The method of claim 1, wherein a step of detecting the alert signal, by the remote alarm center, further includes wirelessly detecting the alert signal.

8. The method of claim 1, wherein a step of detecting the alert signal, by the remote alarm center further comprises recognizing the caller identification of the end-user.

9. The method of claim 1, wherein the predetermined duration is about one to five minutes.

10. The method of claim 1, wherein the plurality of communication channels comprises at least three land lines and three cellular phone calls.

11. The method of claim 1, wherein a step of deactivating the alarm device, by the remote alarm center, upon receipt of the code before expiration of the predetermined duration, further includes the end-user transmitting the code through a keypad of a cellular phone, land line phone, or text.

12. The method of claim 1, wherein a irregular event comprises an unauthorized entry, excessive movement, or incorrect entry procedures.

13. A security method for verifying a merit of a detected alert signal, comprises:

integrating an alarm device at a premises of an end-user, wherein the end-user is at least one of a person who ultimately uses the security method and a person who is intended to ultimately use the security method;

operatively connecting at least one identifying information of the end-user and the premises to a remote alarm center, the remote alarm center having a data storage portion for storing the at least one identifying information;

triggering an alert signal, by the alarm device, the alert signal configured to indicate an irregular event, the alert signal comprising the at least one identifying information of the end-user and the premises;

detecting the alert signal, by the remote alarm center;

recognizing the at least one identifying information from the alert signal;

simultaneously opening a plurality of communication channels between the end-user and the remote alarm center regarding the alert signal;

waiting a predetermined duration after opening the plurality of communication channels for receipt of a code from the end-user, the code configured to cancel a need to contact a response organization;

reporting the alert signal to an alert response organization after expiration of the predetermined duration; and deactivating the alarm device, by the remote alarm center, upon receipt of the code before expiration of the predetermined duration.

14. The method of claim 13, wherein the alarm device includes at least one of the following: window detectors, door detectors, motion sensors, smoke sensors, fire sensors, and medical button both digital and analog closed caption television images or acquisition devices, and cameras.

15. The method of claim 13, wherein the premises is an entry point or an exit point within a perimeter, a border, and a building.

16. The method of claim 13, wherein a irregular event comprises an unauthorized entry, excessive movement, or incorrect entry procedures.

17. The method of claim 13, wherein a step of detecting the alert signal, by the remote alarm center further comprises recognizing the caller identification of the end-user.

18. The method of claim 13, wherein the plurality of communication channels comprises at least three land lines and three cellular phone calls.

19. A security system for verifying a merits of an alert signal, the system comprising:

an end-user, the end-user operable to control a premises, the end-user and the premises comprising at least one identifying information, wherein the end-user is at least one of a person who ultimately uses the security method and a person who is intended to ultimately use the security method;

an alarm device, the alarm device configured to operatively connect to the premises, the alarm device further configured to trigger an alert signal upon detection of an irregular event at the premises;

an alert signal, the alert signal configured to be generated by the alarm device, the alert signal further configured to indicate an irregular event, the alert signal comprising the at least one identifying information of the end-user and the premises;

a code, the code configured to be provided by the end-user, the code further configured to deactivate the alert signal; and an alert response organization, the alert response organization configured to receive the alert signal, the alert response organization further configured to recognize the at least one identifying information of the end-user and the premises, wherein the alert response organization is configured to respond to the premises upon receiving the alert signal, wherein the alert response organization is configured to ignore the premises upon receiving the code before a predetermined duration.

20. The method of claim 13, wherein a plurality of communication channels comprise at least two separate channels.

* * * * *